United States Patent [19]

Harnois

[11] Patent Number: 4,696,528

[45] Date of Patent: Sep. 29, 1987

[54] FUSIBLE SWITCH AND FUSE PULLER ASSEMBLY

[75] Inventor: Carey D. Harnois, Charlottesville, Va.

[73] Assignee: Cooper Industries, Inc., Houston, Tex.

[21] Appl. No.: 891,976

[22] Filed: Aug. 1, 1986

[51] Int. Cl.[4] ..... H01R 13/62

[52] U.S. Cl. ..... 439/160; 81/3.8

[58] Field of Search ..... 81/3.8; 339/45 R

[56] References Cited

U.S. PATENT DOCUMENTS

| | | | |
|---|---|---|---|
| 2,454,878 | 11/1948 | Marler | 81/3.8 |
| 4,140,359 | 2/1979 | Kunz | 339/45 R |
| 4,288,138 | 9/1981 | Berry et al. | 339/45 R |
| 4,429,936 | 2/1984 | Rusenko | 339/45 R |

*Primary Examiner*—Roscoe V. Parker

*Attorney, Agent, or Firm*—E. E. Scott; R. L. Maxwell

[57] ABSTRACT

An integrally formed fuse puller assembled to the insulating base of a fusible switch assembly with portions of said puller movable for disengaging a fuse from a fuse clip on said base.

18 Claims, 8 Drawing Figures

Fig. 1
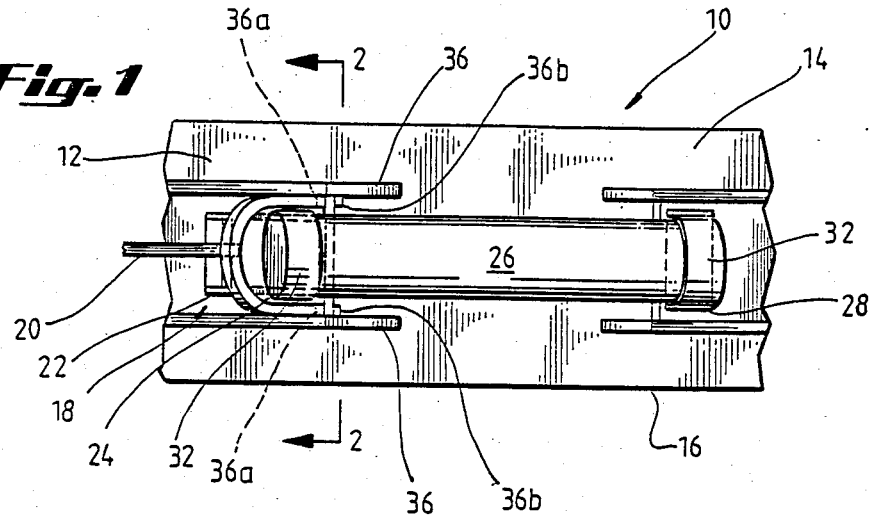
Fig. 2
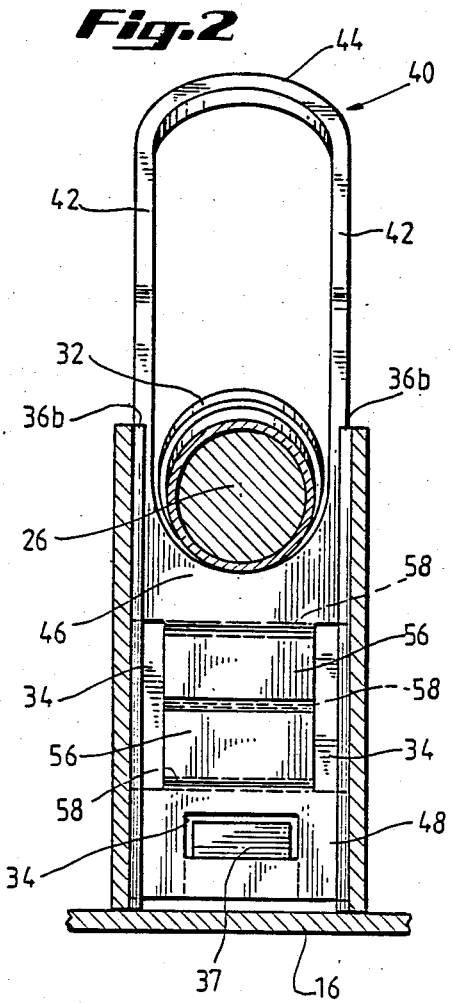
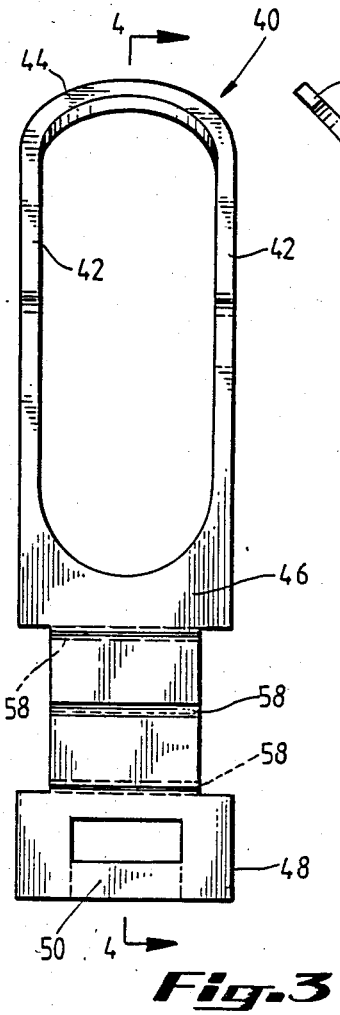
Fig. 3
Fig. 4
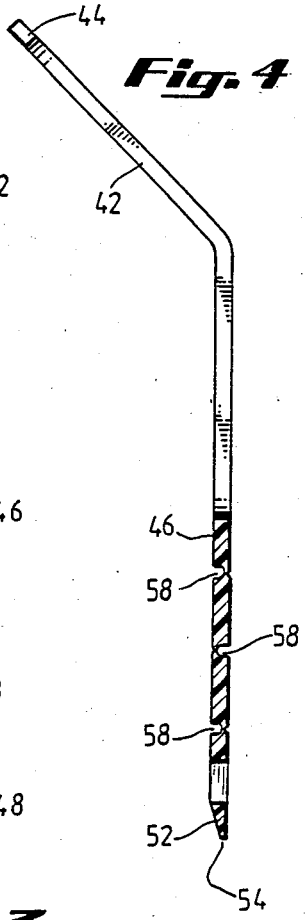

FUSIBLE SWITCH AND FUSE PULLER ASSEMBLY

BACKGROUND OF THE INVENTION

1. Field of the Invention

This invention relates generally to a fuse puller for a fusible switch.

2. Summary of the Prior Art

Fusible switches usually incorporate an insulating base carrying an incoming line terminal for each phase of a multi-plase circuit with a switch blade for each phase operable to extend a respective circuit from the line terminal through a fuse clip having a fuse seated therein. The fuse is usually secured at both ends to a respective fuse clip formed by a pair of spring jaws and some force, usually between 20 and 40 pounds depending on the fuse and clip size, is required for fuse removal. When it is desired to change or inspect a fuse, the usual practice is to open the switch blades by means of a handle to permit access to the enclosure in which the assembly is located, and then to extract the fuse manually from between the clips. Manual extraction is often accomplished by using a screwdriver or the like to lever the fuse loose and can result in breakage since space for fully grasping the fuses to exert the required force is limited. This practice is further subject to criticism since there is a possibility of contacting a live or electrically energized part of the apparatus.

A fuse puller is shown in U.S. Pat. No. 4,288,138 issued to Edgar I. Barry and Joseph C. Drilling and assigned to Square D Company. The fuse puller is assembled for limited movement in a fusible switch base in encircling relationship to fuse mounted on the base for disengaging the fuse from a fuse clip.

SUMMARY OF THE INVENTION

To enable the required fuse removal force to be exerted without the use of a prying tool, the present invention incorporates an integrally formed fuse puller positioned in the insulating base of a fusible switch. The fuse puller comprises an integral body member made of nylon or a similar material encircling one end of a fuse with a handled portion spaced from the parts and from the line of fuse movement so that it may be easily grasped and on moving movable portions of the puller in one direction, a fuse engaging portion of the puller disengages the fuse terminal from the fuse clip.

Separated from the fuse engaging portion and opposite the handle is a lower end portion of the body having means for preventing reverse assembly and means for fixed attachment to the insulating base. The puller further includes pressure responsive means for varying the amount of separation between the fuse engaging means and the lower end portion. In one embodiment, the compressive pressure exerted by a seated fuse is sufficient to maintain the fuse engaging means at a seated fuse position which allows the fuse to remain seated, wherefrom any expansive pressure raises the fuse engaging means from the seated fuse position to a fuse disengaging position. In another embodiment, the fuse engaging means of a puller is at a seated fuse position when the puller is at rest.

It is therefore one object of the present invention to provide a fuse puller for use with a fusible switch.

It is another object of the present invention to provide an improved fusible switch fuse puller assembly.

Other objects, advantages and novel features of the invention will become apparent from the following detailed description of the invention when considered in conjunction with the accompanying drawings wherein:

BRIEF DESCRIPTION OF THE DRAWINGS

FIG. 1 is a top view of a relevant portion of a fusible switch assembly having a fuse puller incorporating the principles of the present invention;

FIG. 2 is a sectional view taken through the line 2—2 in FIG. 1;

FIG. 3 is a front view of the fuse puller incorporating the principles of the present invention;

FIG. 4 is a sectional view taken through the line 4—4 in FIG. 3;

DESCRIPTION OF THE PREFERRED EMBODIMENT

Figure 5:
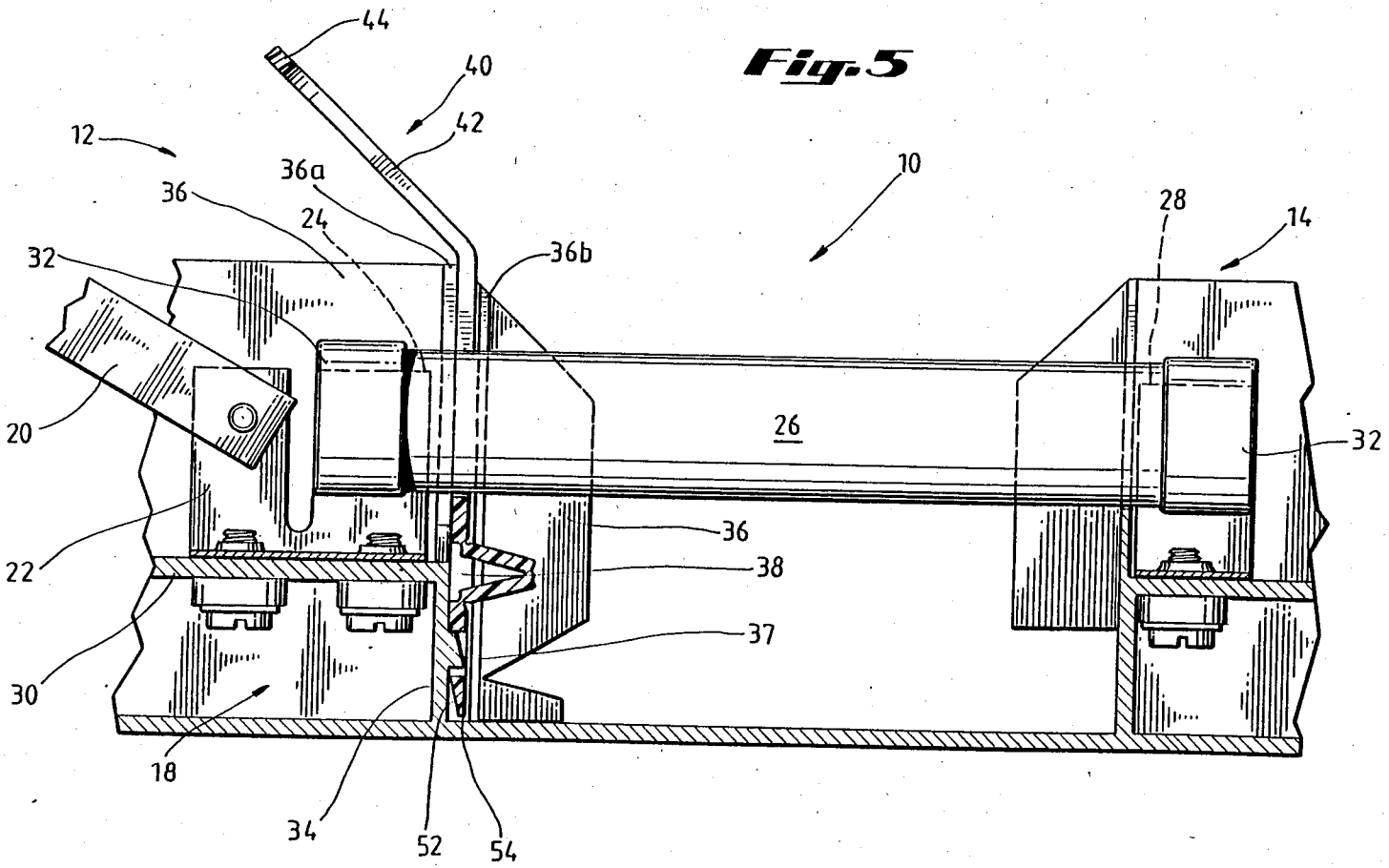
FIG. 5 is a partial sectional view illustrating the fuse puller in a seated fuse position.

In the description which follows, like parts are marked throughout the specification and drawings with the same reference numerals, respectively. The drawing figures are not necessarily to scale and certain features of the invention may be shown exaggerated in scale in the interest of clarity.

In FIG. 1 a relevant portion of fusible switch assembly is illustrated and generally designated by the numeral 10. The switch assembly comprises a line base assembly 12 and a load base assembly 14 mounted a selected distance apart on a wall of an enclosure 16.

The line base assembly includes an insulating base 18 carrying a switch blade 20 hinged to line side fuse clip assembly 22. As is well known in the art, switch blade 20 can be engaged with a contact jaw (not shown) connected to a line terminal (not shown) to extend a connection from the line terminal through the blade 20 to a fuse clip assembly 22.

A cylindrical shaped fuse 26 extends the electrical connection from clip 24 to a clip 28 mounted on an insulating base of the load base 14. From the load base clip 28, a connection may be established to a load by well known means. It will be appreciated that the insulating bases may be secured directly to the wall of the enclosure.

Figure 6:
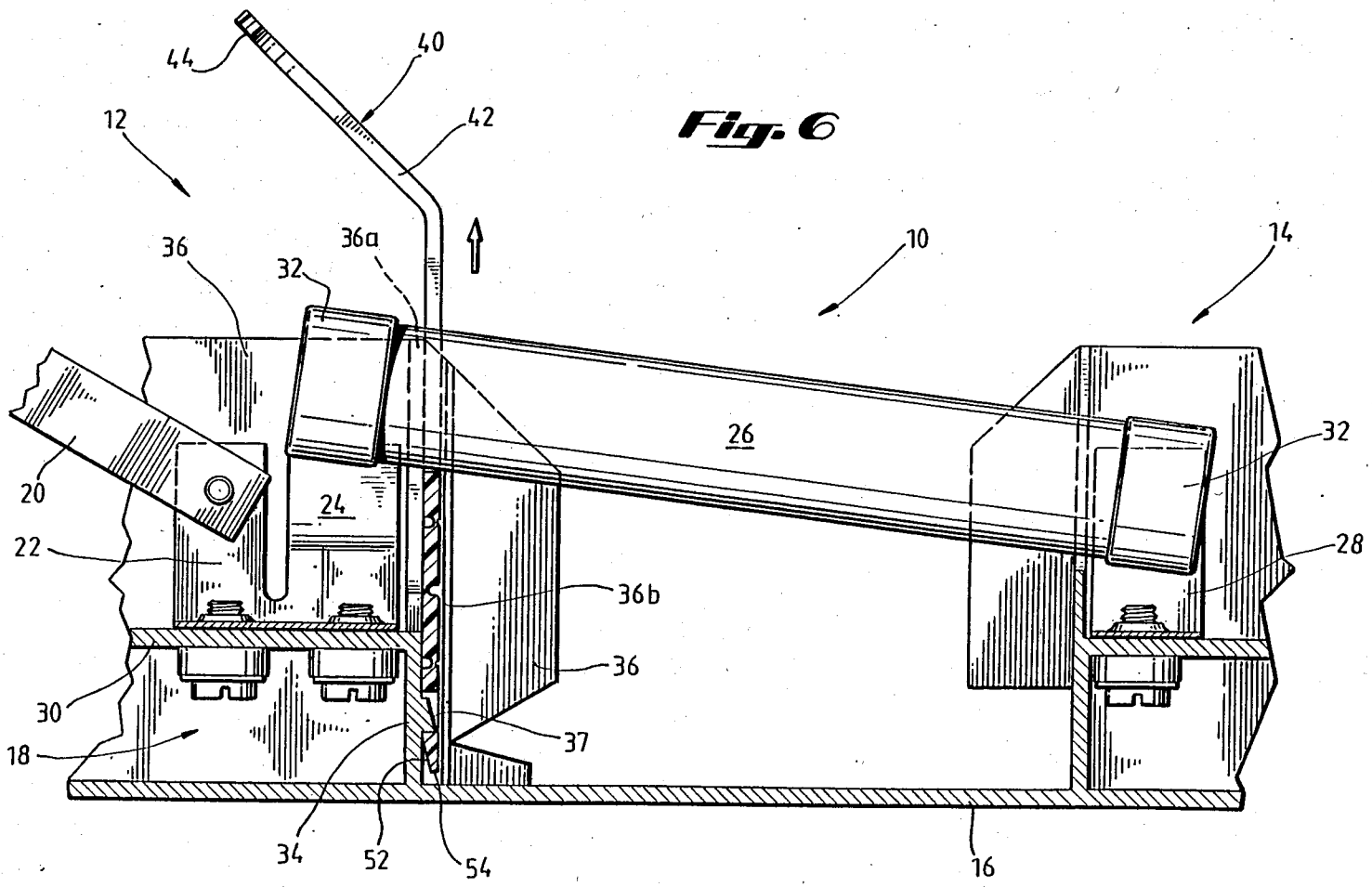
FIG. 6 illustrates the fuse puller in an operated position having disengaged a fuse from a clip.

As best seen from FIGS. 5 to 8, fuse clip assembly 22 is securely mounted on a platform wall 30 of the insulating base, shown generally as 18 in FIGS. 5 and 6, fuse clip 24 being in alignment with clip 28. Each clip comprises a pair of cantilever arcuate jaw members adapted to receive a respective circularly shaped ferrule or terminal 32 at a respective end of fuse 26 therebetween.

The insulating base 18 has an inner wall 34 depending from the platform wall 30 and barrier or partition walls 36 projecting upwardly and downwardly from the platform wall 30 and outwardly from the inner wall 34 adjacent to opposing jaws of clip 24 to define a compartment for said clip assembly 22. The platform wall 30 and depending wall 34 terminate at a position upwardly substantiated by first projecting portions **36*a* of partition walls 36** and spaced apart from second projecting portions 36*b* of partition walls 36 to define an upwardly open linear guideway or passage 38 for receiving a fuse puller 40. The only portion of the insulating base 18 which intrudes into passage 38 is a projecting portion 37 of inner wall 34. Portion 37, most clearly seen in FIGS. 5 to 8, porjects only part way across passage 38 and has flat upward and downward facing surfaces and an inclined outward facing surface. Portion 37 is positioned to obstruct portions of puller 40 and engage portions of puller 40 as described further below.

The fuse puller 40 is an integrally formed body of nylon or similar material. The puller 40 includes spaced side legs 42 terminating at an upper or one end in a finger loop or handle portion 44. The side legs 42 terminate at the opposite end in fuse engaging means such as a fuse cradle or body portion having an arcuate upper edge 46. The side legs are of such length and configuration that handle portion 44 is non-interferingly locatable and readily accessible for manual engagement when the puller 40 is installed in a fusible switch assembly 10. Referring to FIGS. 5 to 8, legs 42 bend and extend away from fuse 26 to facilitate manual engagement of handle portion 44 and to ensure that handle portion 44 does not block or otherwise interfere with fuse engagement or disengagement.

At the end of the fuse puller 40 opposite the handle portion 44 is the lower end portion 48. In the figures, and most clearly in FIGS. 3 and 4, the lower end portion is shown as a web. The thickness of the web is uniform; being generally, as is also true for the rest of the body, just slightly less than the width of passage 38; except at its base 50, that is, except for the bottom most strut-like portion of the web. From one of the topmost edges of the base 50 down, along a predetermined span to a predetermined depth which is less than the full uniform thickness of the web, the thickness of the web is progressively less. Because of this change in web depth, and because this change does not equal full uniform web depth, puller 40 has inclined surface 52, and flat bottom surface 54.

Between the fuse engaging portion 46 and the lower end portion 48 is means for allowing expansion of and/or reduction in the transverse length of the body. In the figures, and most clearly in FIGS. 3 and 4, this means is shown as a middle body portion 56 which, when fully extended, is generally flat and lying in the same plane as web 48. In the embodiment shown in FIGS. 1 to 6, oriented as in FIGS. 3 and 4, middle body portion 56 has six horizontal slots therein. Three of the six slots being larger than the three others, two large slots and an intermediate small slot run horizontally across one side of the middle body portion 56, two small slots and an intermediate large slot run horizontally across the other side. The topmost, intermediate, and bottommost slots on opposite sides are positioned directly opposite each other to define three horizontal, linear, weakened strips 58 across the middle body portion 56. These weakened strips constitute "living hinges" which when formed as shown in FIG. 4 will bend as shown in FIG. 5 when the fuse engaging portion 46 is pressed toward the lower body portion 48 and, simultaneously, the lower body portion 48 is held stationary. It will be appreciated that the "living hinges" described above constitute expansible folds or means for increasing the amount of separation between the fuse engaging portion and the lower end portion when the body is initially bent as in FIG. 5.

Fuse puller 40 is installable in switch assembly 10 by slidable insertion, lower end first, into passage 38. Provided the puller 40 is posed during insertion so that inclined surface 52 faces inner wall 34 when lower end portion 48 and inner wall 34 are adjacent, inclined surface 52 and portion 37 are positioned to make inclined surface contact, whereupon continued slidable insertion of puller 40 causes web flexure and resilient engagement when inclined surface 52 passes an inclined outward facing surface of portion 37. At that position partition wall portions 36*b* of partition walls 36, inner wall 34, and portion 37 of inner wall 31 combine to fixedly position the lower body portion 48 of puller 40. It will be appreciated that a flat upward facing surface of portion 37 and flat bottom surface 54 are capable of cooperating to block further puller 40 insertion if they make contact; hence, reverse assembly or an incorrect posture of puller 40 in assembly 10 is prevented.

Installation of a fuse 26 into a fusible switch having a fuse puller assembly will, because of the compressive pressure exerted on those portions of the puller 40 between and including the fuse engaging portion 46 and fixedly positioned lower body portion 48, cause the puller of FIGS. 1 to 6 to flex as shown in FIG. 5. To disengage the seated fuse 26, handle 44 is manually engaged and pulled so as to exert an expansive pressure on other portions of the puller body. This pressure will manifest itself in expansion of middle body portion 56 as shown in FIG. 6, which expansion results in upward movement of fuse engaging portion 46. Upward movement of fuse engaging portion 46 forces fuse 26 against the mouth of the jaws of clip 24, ultimately resulting in jaw opening sufficient to release said fuse 26.

Figure 7:
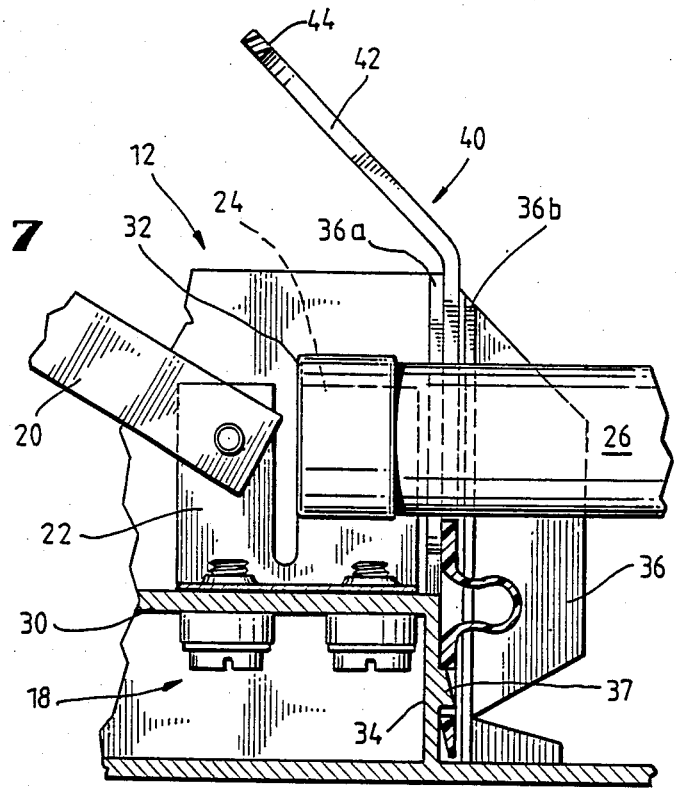
FIG. 7 is a partial sectional view illustrating alternative fuse pullers in a seated fuse position.
Figure 8:
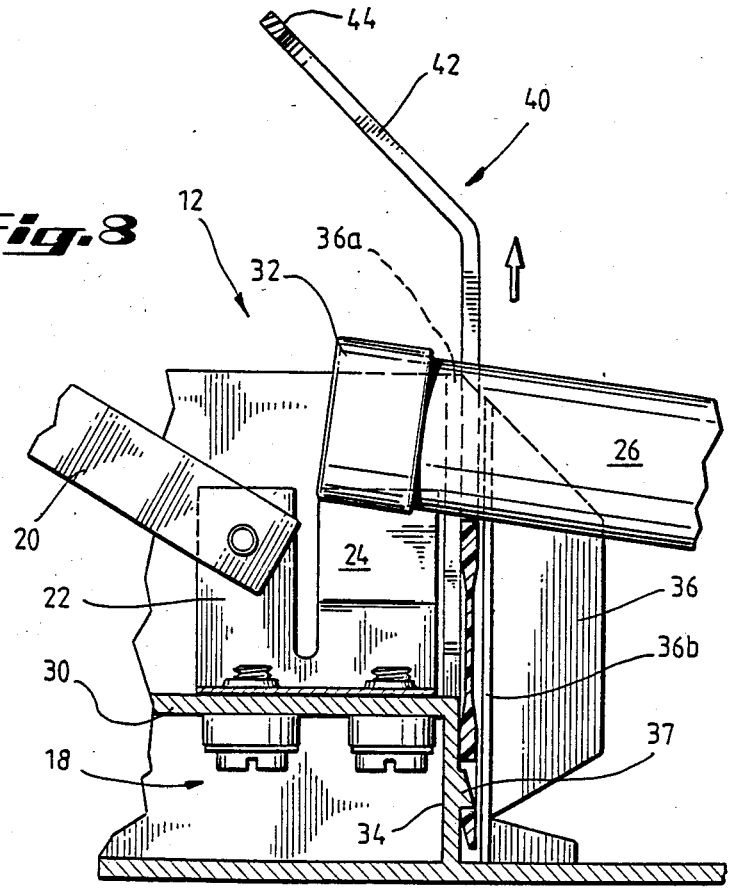
FIG. 8 illustrates the alternative fuse pullers of FIG. 7 in an operated position having disengaged a fuse from a clip.

Obviously, many modifications and variations of this invention are possible in light of the above teachings. For example, instead of having "living hinges" as described above, fuse puller 40 could have a single weakened and/or flexible portion that, for example, forms a loop under compressive pressure. As another example, fuse puller 40 could be formed to include a looping portion when at rest, that is, when it is not subjected to a compressive or expansive force along its transverse length. The fuse engaging means 46 of this embodiment could be positioned below a seated fuse when the puller 40 is at rest, wherefrom expansive force on the puller 40 would disengage the fuse. Both of these embodiments are shown in FIGS. 7 and 8, with the understanding that the puller is, in FIG. 7, compressed in the former embodiment and at rest in the latter embodiment. It is to be understood therefore that within the scope of the appended claims, the invention may be practiced otherwise than as specifically described.

I claim:

1. A fuse puller apparatus comprising:

a fuse puller body including a handle portion;

the fuse engaging portion; a lower end portion;

a body portion between said fuse engaging portion and said lower end portion, said body portion having a transverse length between said fuse engaging portion and said lower end portion; and means for allowing expansion of the transverse length of said body portion between said fuse engaging portion and said lower end portion.

2. The fuse puller of claim 1 in which said fuse puller body further includes means for allowing reduction in the transverse length of said body between said fuse engaging portion and said lower end portion.

3. The fuse puller of claim 2 in which said means for allowing reduction in and said means for allowing expansion of the transverse length of said body between said fuse engaging portion and said lower end portion comprises at least one structurally weakened portion of the body.

4. The fuse fuller of claim 3 in which the at least one structurally weakened portion of the body comprises a middle body portion having a flexible loop.

5. The fuse puller of claim 3 in which the at least one structurally weakened portion of the body comprises a middle body portion having compressible folds.

6. A fusible switch and fuse puller assembly comprising:

an insulating assembly having supporting means for slidably receiving, holding, and guiding the movements of portions of a fuse puller;

a pair of spaced fuse clips mounted on said insulating assembly, said clips having means for releasing a seated fuse, said means for releasing a seated fuse actuatable by force exerted on said fuse in a predetermined direction; and a fuse puller having an integral body of insulating material encircling the axis of said fuse, portions of said body held by the supporting means of said insulating assembly, said body further including, a handle portion offset outward and displaced from said fuse for manual engagement and exertion of an expansive pressure on other portions of said body, said expansive pressure being in the predetermined direction which actuates the means for releasing a seated fuse, a fuse engaging means capable of assuming a range of positions from a low position to a high position.

a lower end portion fixedly attached to said insulating assembly, a body portion between said fuse engaging means and said lower end portion, said body portion having a length between said fuse engaging means and said lower end portion, the length defining an amount of separation, and force responsive means for varying the amount of separation between said fuse engaging means and said lower end portion, the compressive force exerted by a seated fuse being sufficient to maintain said fuse engaging means at a seated fuse position, said seated fuse position being lower than the high position, and any expansive force raising the fuse engaging means from the seated fuse position to the high position being sufficient to actuate the means for releasing said seated fuse.

7. The fusible switch and fuse puller assembly of claim 6 in which said force responsive means for varying the amount of separation between said fuse engaging means and said lower end portion further comprises an intermediate body portion having compressible and expansible folds.

8. A fusible switch assembly having a fuse puller for disengaging a fuse extending between a pair of spaced fuse clips secured to an insulating assembly, the improvement comprising:

said insulating assembly having portions defining linear guide slots adjacent one of said clips, said guide slots extending transverse to the axis of said fuse and positioned intermediate the ends of said fuse and between said clips; and a body of insulating material having a handle portion adapted to be manually engaged, a first body portion essentially fixedly positioned within said guide slots, a second body portion moveably positioned within said guide slots, and a portion for engaging said fuse to disengage said fuse from at least one of said clips in response to manual engagement of said handle portion and movement of said second body portion in said guide slots in one direction, said movement of said second body portion precipitated by movement of said handle portion.

9. The assembly of claim 8 wherein said body further comprises a middle body portion having folds, said folds expansible in response to movement of said handle portion.

10. The assembly of claim 9 wherein said handle portion is offset past one end of said fuse to enable movement of said fuse past said handle portion.

11. A fusible switch and fuse puller assembly comprising:

an insulating base having a platform wall to which a first fuse clip is secured with a clip having a pair of spring jaws engaging one terminal of the fuse extending to another fuse clip;

an inner wall depending from the platform wall, and partition walls projecting upwardly and downwardly from the platform wall and outwardly from the inner wall;

said partition walls having portions defining linear guide slots transverse and adjacent to said inner wall;

said inner wall overlapped by said fuse;

a switch carried by said platform wall for extending a circuit to said first fuse clip and fuse;

a body of insulating material having one portion offset outward and displaced from said switch and fuse for manual engagement, said body having a fuse engaging portion and a lower end portion positioned within said guide slots intermediate opposite longitudinal ends of the fuse; and said body having means for allowing reduction in the transverse length of said body between said fuse engaging portion and said lower end portion.

12. The assembly of claim 11 wherein said lower end portion includes means for fixedly engaging the inner wall.

13. The assembly of claim 12 wherein:

said lower end portion has non-uniform sides which span the guide slots; and said lower end portion further includes means for blocking movement of the puller down the guide slots prior to the body reaching the predetermined distance for fixed engagement if one of the non-uniform sides faces the inner wall.

14. An apparatus for pulling a fuse, said fuse having a leading side and a trailing side with respect to direction of pull, said apparatus comprising:

a fuse puller body including a handle portion;

a fuse engaging portion for engaging the fuse on its trailing side;

a lower end portion;

a body portion between said fuse engaging portion and said lower end portion, said body portion having a transverse length between said fuse engaging portion and said lower end portion; and means for allowing expansion of the transverse length of said body between said fuse engaging portion and said lower end portion.

15. The fuse puller of claim 14 in which said fuse puller body further includes means for allowing reduction in the transverse length of said body between said fuse engaging portion and said lower end portion.

16. The fuse puller of claim 15 in which said means for allowing reduction in and said means for allowing expansion of the transverse length of said body between said fuse engaging portion and said lower end portion comprises at least one structurally weakened portion of the body.

17. The fuse puller of claim 16 in which the at least one structurally weakened portion of the body comprises a middle body portion having a flexible loop.

18. The fuse puller of claim 16 in which the at least one structurally weakened portion of the body comprises a middle body portion having compressible folds.

* * * * *